US006857561B2

(12) United States Patent
Williams et al.

(10) Patent No.: US 6,857,561 B2
(45) Date of Patent: Feb. 22, 2005

(54) COMPOSITE CONTAINER WITH MEMBRANE AND BEAD CLOSURE SYSTEM

(75) Inventors: Alan D. Williams, Camden, SC (US); Michael T. Drummond, Laurinburg, SC (US)

(73) Assignee: Sonoco Development, Inc., Hartsville, SC (US)

( * ) Notice: Subject to any disclaimer, the term of this patent is extended or adjusted under 35 U.S.C. 154(b) by 37 days.

(21) Appl. No.: 10/436,169

(22) Filed: May 12, 2003

(65) Prior Publication Data

US 2004/0226990 A1 Nov. 18, 2004

(51) Int. Cl.[7] ..... B65D 43/02

(52) U.S. Cl. ..... 229/123.1; 220/359.3; 220/359.4; 229/123.2

(58) Field of Search ..... 229/123.1, 123.2, 229/5.5; 220/359.1, 359.3, 359.4

(56) References Cited

U.S. PATENT DOCUMENTS

| | | | | | |
|---|---|---|---|---|---|
| 3,454,210 | A | * | 7/1969 | Spiegel et al. | 229/123.1 |
| 3,990,603 | A | | 11/1976 | Brochman | |
| 4,055,672 | A | * | 10/1977 | Hirsch et al. | 229/123.1 |
| 4,196,841 | A | * | 4/1980 | Smith et al. | 229/123.2 |
| 4,215,791 | A | | 8/1980 | Brochman | |
| 4,280,653 | A | | 7/1981 | Elias | |
| 4,372,460 | A | | 2/1983 | Brochman et al. | |
| 4,428,494 | A | | 1/1984 | Hirota et al. | |
| 4,452,842 | A | * | 6/1984 | Borges et al. | 229/123.1 |
| 4,771,937 | A | | 9/1988 | Kamada et al. | |
| 4,890,759 | A | | 1/1990 | Scanga et al. | |
| 4,934,544 | A | | 6/1990 | Han et al. | |
| 4,944,409 | A | | 7/1990 | Busche et al. | |
| 5,062,569 | A | * | 11/1991 | Hekal | 220/359.3 |
| 5,160,767 | A | | 11/1992 | Genske et al. | |
| 5,176,314 | A | * | 1/1993 | Akazawa et al. | 229/123.1 |
| 5,213,227 | A | | 5/1993 | Koyama et al. | |
| 5,240,133 | A | * | 8/1993 | Thomas, Jr. | 220/359.3 |
| 5,979,748 | A | | 11/1999 | Drummond et al. | |
| 6,196,450 | B1 | | 3/2001 | Varadarajan et al. | |
| 6,234,386 | B1 | | 5/2001 | Drummond et al. | |
| 6,264,098 | B1 | * | 7/2001 | Drummond et al. | 229/123.1 |
| 6,302,321 | B1 | | 10/2001 | Reese et al. | |
| 6,544,613 | B1 | * | 4/2003 | Varadarajan | 220/359.1 |
| 2001/0049001 | A1 | | 12/2001 | Mueller | |
| 2002/0014523 | A1 | | 2/2002 | Drummond et al. | |

FOREIGN PATENT DOCUMENTS

| | | |
|---|---|---|
| EP | 0 417 380 A3 | 3/1991 |

OTHER PUBLICATIONS

European Search Report for European Application No. EP 04251918.1, Filed Mar. 31, 2004, Date of Completion Aug. 18, 2004.

* cited by examiner

*Primary Examiner*—Gary E. Elkins
(74) *Attorney, Agent, or Firm*—Alston & Bird LLP

(57) ABSTRACT

A composite container of paperboard has a polymeric film barrier layer on the inner surface thereof. A rolled bead is formed at a top end of the container and a membrane closure is bonded to the bead by a first heat seal material on the bead and a second heat seal material on the membrane. The heat seal materials preferably comprise ethylene acid copolymer such as methacrylic acid or acrylic acid, partially neutralized with zinc or sodium ions. A primer layer is disposed between the heat seal material on the bead and the polymer barrier layer of the container. The primer provides a high z-direction bond strength but is designed to fail in a shear tearing mode when peeling the membrane from the bead, such that the heat seal material on the bead is detached from the bead and remains attached to the membrane. The primer prevents tearing of the polymer barrier layer of the container.

21 Claims, 2 Drawing Sheets

COMPOSITE CONTAINER WITH MEMBRANE AND BEAD CLOSURE SYSTEM

FIELD OF THE INVENTION

The invention relates to a composite can closure system that facilitates opening of the container by peeling a membrane closure from a rolled bead at the container end, but which additionally provides a seal that is secure against accidental opening resulting from transportation of the sealed container at relatively high elevations and/or exposure to elevated temperatures.

BACKGROUND OF THE INVENTION

Food and drink products are often packaged in composite containers of the type having a tubular container body whose wall derives its structural strength from one or more paperboard plies spirally or convolutely wound about the tube axis and adhered together. The container body generally includes a moisture-impervious liner adhered to the inner surface of the paperboard body wall. The liner can be of various constructions, in some cases having a foil layer serving as the primary barrier of the liner, in other cases being made up entirely of polymers without any foil layer. The invention relates particularly to those containers having non-foil-based liners, also sometimes referred to as polymer liners. The container body at a top end has a rolled bead formed by rolling the tubular end of the container body outwardly and then downwardly. A membrane lid or closure is adhered to the end surface of the bead to hermetically seal the top end of the container closed. A removable and replaceable overcap generally is placed over the membrane and engages the bead in a snap-fit fashion so that when the container is initially opened by peeling off the membrane, the container can be resealed by replacing the overcap. Such containers are used for packaging a variety of food products.

To maintain product freshness until the package reaches the consumer, it is important for the hermetic seal between the membrane and the bead to remain intact during shipment and storage of the package. In some circumstances, the membrane can be subjected to internal pressure within the container as a result of temperature change and/or altitude change. For example, if the package is sealed at sea level and then transported to a substantially higher altitude or elevation, there will be a pressure on the membrane acting outwardly so as to tend to lift the membrane away from the bead; elevated temperature has a similar effect. The membrane must be able to withstand such pressures without the hermetic seal being compromised.

At the same time, it is desirable for the consumer to be able to peel the membrane off the bead with relatively little force. Additionally, the membrane should peel cleanly from the bead.

The above requirements tend to be in opposition with one another. Thus, achieving a strong seal that can withstand internal pressures generally tends to require a higher peel force to remove the membrane, and is more likely to result in tearing of the polymer barrier layer of the container liner upon opening.

The most commonly used polymer for obtaining a secure bond between the membrane and bead is SURLYN®, which is an ethylene acid copolymer having acid groups partially neutralized with zinc or sodium ions. SURLYN® bonds securely to itself. Typically a layer of SURLYN® is provided on the liner as well as on the membrane closure, and the two SURLYN® layers are heat-sealed together to attach the membrane to the bead of the container.

SURLYN® presents a number of benefits in high-speed commercial manufacture of composite containers. In particular, it permits a relatively higher "margin of error" during variations in manufacturing that will typically occur, relative to other adhesive systems. The problem with SURLYN® is that while it bonds extremely well, it can also be difficult to open (i.e., it bonds too well).

The above-noted problems are further exacerbated where the liner includes a polymeric barrier layer, as opposed to the more conventional foil layer. The foil layer tends to be frangible and will readily yield upon the application of the force by the consumer in opening the container. A polymeric barrier layer, on the other hand, has inherent resilience so that as the membrane is removed, the polymeric layer tends to stretch and tear in a manner that can leave undesired strings of material.

As a result, it is generally proposed to use alternative adhesive systems other than SURLYN®. For example, U.S. Pat. No. 5,979,748 describes the use of heat-flowable polymers such as high or low density polyethylene, metallocenes, and mixtures thereof, as the seal material on the bead, and polymers such as ethylene vinyl acetate, polyethylene, ethyl methyl acrylate, metallocenes, and mixtures thereof, as the seal material on the membrane. This adhesive system is designed to facilitate fracture of the adhesive system itself between the membrane and the liner on the bead. See also Elias U.S. Pat. No. 4,280,653, which describes the use of a heat-sealable co-extruded film laminate joined to the foil liner of the container for bonding the membrane to the bead. The laminate is designed to fail between its layers when the membrane is peeled off. The two layers of the laminate are dissimilar polymers. Specifically, the layer immediately adjacent the foil liner is polypropylene, and the other layer is a blend of polyethylene and ethyl methyl acrylate. The bond between these layer is weaker than the bond between the polypropylene layer and the foil layer, and weaker than the bond between the polyethylene-ethyl methyl acrylate layer and the membrane, such that these layers separate when the membrane is peeled off.

However, as noted, SURLYN® offers significant benefits as a sealant and hence it would be desirable to be able to use this sealant while overcoming the previously noted difficulties associated with its use in a membrane/bead closure system.

SUMMARY OF THE INVENTION

In order to obtain the significant benefits associated with the commercial use of SURLYN® and similar types of sealants, but also to ensure the desired integrity of the seal and the desired ease of opening of the container, the present invention involves the use of a primer system between the polymer barrier layer of the container liner and a first heat seal material (e.g., SURLYN® or a similar type of sealant) that is disposed on the bead to bond the membrane thereto. In accordance with the invention, the primer provides a relatively high z-direction bond strength between the barrier layer and the first heat seal material on the bead. The z-direction bond strength is what resists detachment of the membrane under pressure loads from internal pressure within the container. At the same time, the primer provides a shear strength between the barrier layer and first heat seal material that is weaker than that between the first heat seal material and the second heat seal material (i.e., that on the membrane), and also weaker than the bond between the second heat seal material and the membrane closure.

Accordingly, peeling of the membrane closure from the end surface of the bead tends to cause the first heat seal material to remain attached to the membrane closure and to be detached from the barrier layer of the container liner at the end surface of the bead.

The barrier layer of the liner can comprise various polymer film materials, including polyethylene terephthalate (PET), oriented polyethylene terephthalate (OPET), polypropylene (PP), oriented polypropylene (OPP), oriented or cast nylon, and the like. The films can be metallized if desired. As noted, the heat seal material preferably is an ethylene acid copolymer, such a methacrylic acid or acrylic acid, having acid groups partially neutralized with zinc or sodium ions. One example of such a heat seal material is SURLYN® available from Dupont; another example is TRANCEND® also available from Dupont. Preferred primers are two-part primer systems to bond the sealant to the barrier layer. For example, two-part urethane primer systems can be used, which employ a hydroxyl-terminated polyol and a di-functional isocyanate that when mixed together react to form a urethane having strong "z-direction" bonding properties to provide a secure bond at temperatures up to about 140° F. (or conditions prevailing at high altitude). The urethane nevertheless may be relatively easily sheared upon the application of a tangential force.

By using this approach, the opening mechanism is either through the primer and/or at the interface between the primer and the polymeric barrier layer, but without requiring shearing of the polymer layer itself, with attendant stretching and "stringing". In either event, the heat seal material applied to the bead will be detached from the barrier layer and remain attached to the membrane.

In a preferred embodiment of the invention, the first heat seal material covers the entire surface of the barrier layer and forms an inner surface of the container that comes in contact with product contained in the container.

In another embodiment of the invention, the primer can be applied to the container liner in a partial-coverage pattern as opposed to covering the entire surface of the liner. The primer pattern advantageously is such that there is no path along the bead, from inside to outside the container, that has an interruption in primer coverage. For instance, in one embodiment the pattern comprises a cross-hatch pattern of narrow lines of primer forming a grid, the spacing between the lines being less than the width of the bead.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
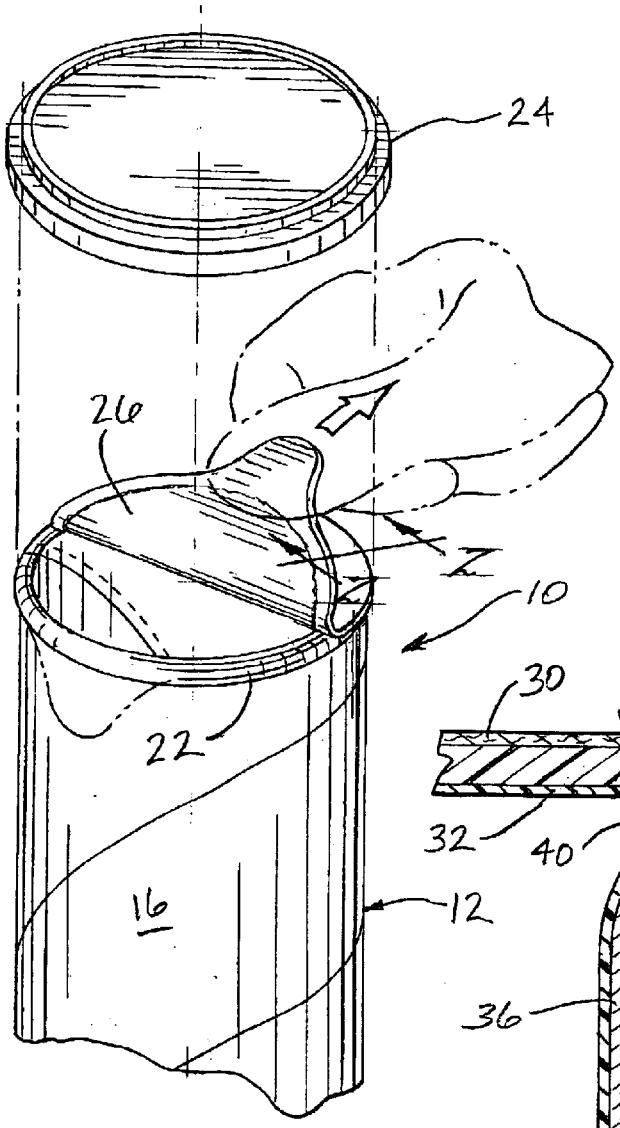
FIG. 1 shows a container having a membrane closure attached thereto in accordance with the invention and also showing an overcap that may be engaged over the bead at the top end of the container, wherein the membrane is shown being peeled back to initially open the container.
Figure 2:
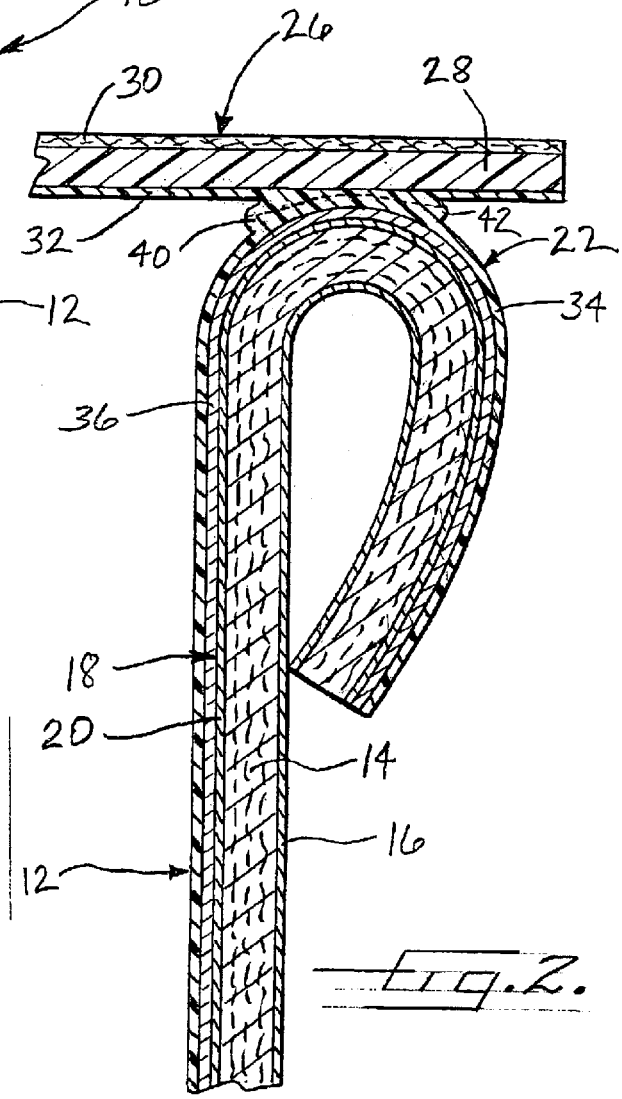
FIG. 2 is a cross-sectional view through the bead of the container and through the membrane, taken on line 2—2 of FIG. 1.

FIGS. 1 and 2 depict a container 10 having a membrane closure affixed thereto in accordance with one embodiment of the invention. The container 10 includes a tubular container body 12 that may be formed by various methods and may have various constructions. In general, the container body 12 can be made by winding at least one structural body ply 14 about a forming mandrel (not shown) and either adhering overlapping edges of a single body ply to each other to form a tubular structure, or, in the case of multiple body plies, winding the plies one upon another and adhering opposing faces of the plies to one another to form a tubular structure. The body ply or plies can be wound either spirally or convolutely. The body ply or plies may advantageously comprise paperboard. The container body 12 may also include an outer ply 16 wrapped about an exterior surface of the outermost body ply and adhered thereto. The outer ply 16 may comprise, for example, a thin non-structural ply of paper or polymer film, and may include graphics and/or indicia printed or otherwise provided on its exterior surface.

The container body 12 also includes a liner 18 adhered against an inwardly facing surface of the innermost body ply 14. The liner 18 is provided for forming a barrier substantially impervious to moisture and/or gases such as oxygen. In the packaging of food and drink products in particular, it is often important to ensure that the container wall have a water vapor transmission rate (WVTR) below a certain specified value, and/or to ensure that the container wall have an oxygen transmission rate (OTR) below a certain specified value. Depending upon the requirements in a particular case, the material(s) that are suitable for the liner 18 may vary. The present invention particularly concerns containers in which the liner ply is a non-foil-based liner whose primary barrier material is polymeric. At a minimum, as shown, such a liner 18 comprises at least one layer 20 of polymer that forms the barrier to moisture and/or gases. However, the liner can additionally comprise one or more further layers (not shown), such as a kraft paper backing layer joined to an outwardly facing surface of the polymer barrier layer 20. The polymer barrier layer 20 can comprise various polymers, suitable non-limiting examples of which include polyethylene terephthalate (PET), polypropylene (PP), nylon, or the like. The barrier layer can be metallized (e.g., by vapor deposition or vacuum sputtering of metal such as aluminum onto the polymer) to further enhance barrier properties of the layer. The polymer barrier layer can be oriented (e.g., OPET or OPP) to enhance the tensile strength or tear-resistance of the layer, or can be both oriented and metallized (e.g., MOPET or MOPP).

The container 10 further includes a rolled bead 22 at a top end of the container body 12, formed by rolling the top edge of the wall of the container body 12 radially outwardly and then downwardly toward a lower end of the container body. The bead 12 can be formed by providing a die of suitable configuration and forcing the top end of the container body axially against the die to roll an upper portion of the body outwardly and then downwardly. The bead 12 is provided, among other reasons, so that a removable and replaceable overcap 24 can be snap-fit onto the top end of the container in engagement with the bead. The overcap provides a way to re-close the container after it has initially been opened.

The primary sealing of the top end of the container, however, is provided by a flexible membrane closure 26 that is bonded to the end surface of the bead 22 after the container is filled. The membrane closure 26 can be of various constructions. As one example, the membrane can comprise at least a moisture and/or gas barrier layer 28 of metal foil and a further layer 30 bonded to the foil layer to impart enhanced tear-resistance to the membrane. Alternatively, the membrane can comprise a metallized polymer barrier layer. The layer 30 can be a paper layer as shown, or can be a polymer layer if desired. After the membrane closure 26 is bonded to the bead 22, the overcap 24 is then placed over the membrane and engaged with the bead. When the consumer wishes to open the sealed container, the overcap 24 is removed and then the membrane closure 26 is peeled off the bead as depicted in FIG. 1. The container is re-closed by replacing the overcap.

To bond the membrane closure 26 to the bead, the membrane closure includes a sealant 32 on its under surface, and a sealant 34 is provided on the end surface of the bead 22. The sealants 32 and 34 comprise synthetic thermoplastic materials that can be bonded to each other by heat-sealing, wherein the two layers of sealants are heated (typically by a heat-sealing head applied against the membrane's upper surface to heat the layers through the membrane) to soften them and render them flowable, the two layers essentially flow together and meld with each other, and then heating is discontinued and the sealant materials cool and solidify such that they are bonded together. The sealant 32 on the membrane closure can be a cast or blown film that is laminated to the foil layer 28, or an extrusion coating on the foil layer. The sealant 34 on the bead preferably comprises a layer that covers the entire inner surface of the container liner's barrier layer 20 and forms the innermost surface of the container body that is in contact with the contents of the container. The sealant layer 34 can be a cast or blown film or an extrusion coating. When the bead is formed, the sealant 34 thus is disposed on the top or end surface of the bead.

The present invention is directed toward the problem of ensuring that the bond between the membrane closure 26 and the bead 22 is sufficiently strong to resist inadvertent failure of the hermetic seal therebetween as a result, for example, of subjecting the sealed container to elevated temperature leading to an increase in internal pressure in the container. The internal pressure can also increase as a result of a change in altitude, as when the container is sealed at a relatively low altitude or elevation and is then transported to a relatively high altitude or elevation. In any event, when the internal pressure becomes high, the tendency is for the membrane closure to be pushed upward away from the bead, which can sometimes cause the seal between the membrane closure and bead to be breached. To prevent such an occurrence, it is desired that the bond between the membrane closure and bead be strong.

At the same time, it is desired that the membrane can be peeled from the bead without having to exert a great deal of force. Easy peelability, however, generally favors a weaker bond between the membrane closure and bead. Additionally, it is desired that the membrane can be cleanly peeled from the bead so that there are no jagged edges or strings of polymer material left on the bead.

Figure 3:
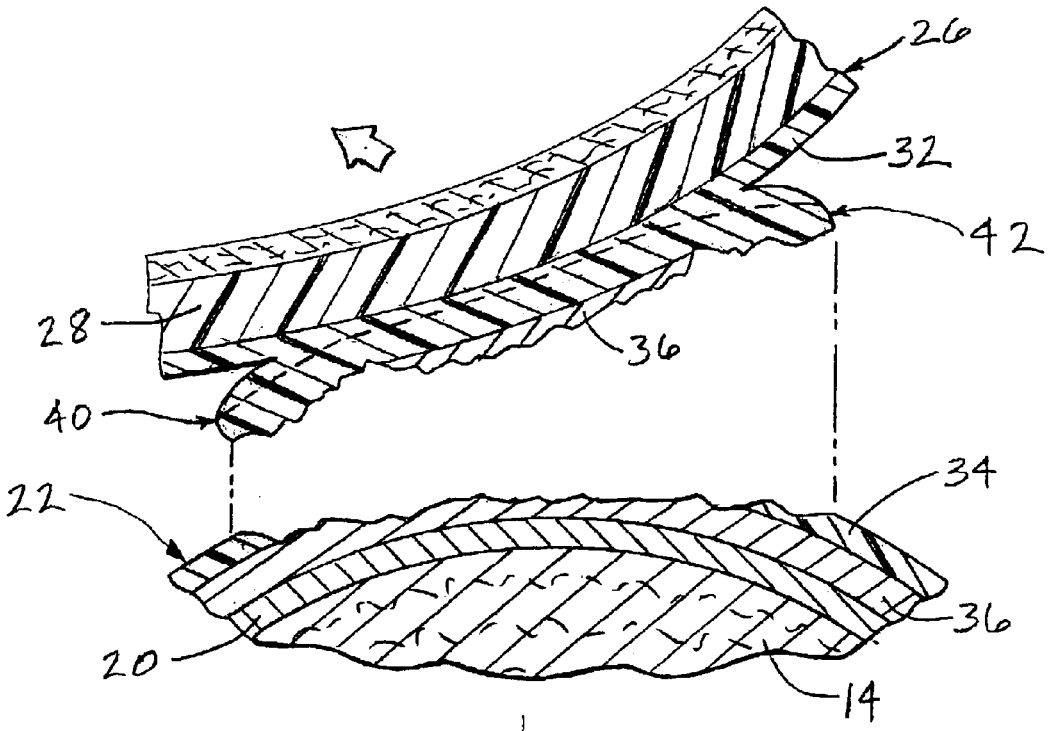
FIG. 3 is a greatly magnified cross-sectional view of the membrane having been detached from the bead in accordance with one failure mechanism in accordance with an embodiment of the invention.
Figure 4:
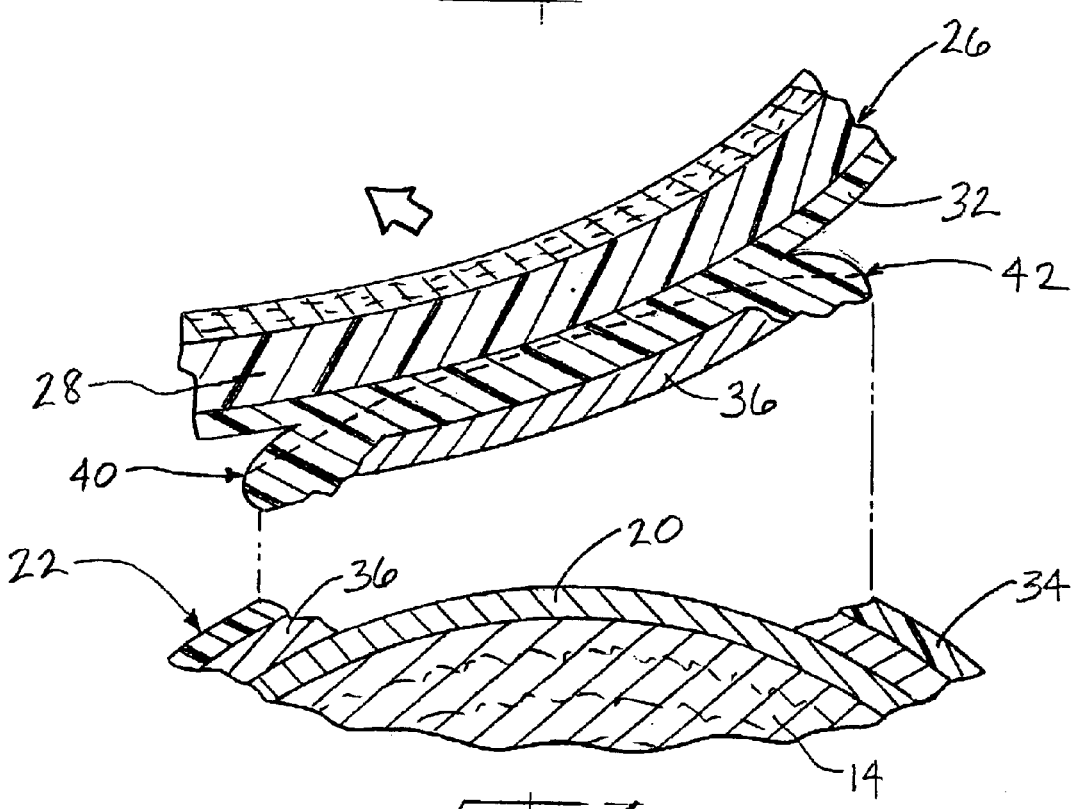
FIG. 4 is a view similar to FIG. 3, showing an alternative failure mechanism in accordance with an embodiment of the invention.

In accordance with the present invention, these countervailing requirements are met by providing a primer 36 between the barrier layer 20 of the container liner and the layer of sealant 34. The primer 36 serves to provide a relatively high z-direction bond strength between the membrane closure 26 and the barrier layer 20 on the bead 22 so as to resist detachment of the membrane caused by high internal pressure in the container. Furthermore, the primer 36 ensures that when a shear tearing load is placed on the primer layer during peeling of the membrane closure from the bead, the primer layer, and/or its attachment to the barrier layer, will fail at a relatively low shear load. The failure mode is depicted in FIGS. 3 and 4. In FIG. 3, the primer layer 36 has failed internally or cohesively by fracturing into two partial thicknesses, one of which remains attached to the membrane 26 and the other of which remains attached to the bead 22. In FIG. 4, the bond between the primer layer 36 and the barrier layer 20 of the container liner has failed adhesively, such that the primer layer remains attached to the membrane closure when the membrane is peeled off the bead. Either type of failure mode can occur in accordance with the invention; in each case, the sealant 34 on the end surface of the bead is detached from the bead and remains adhered with the membrane closure.

Thus, the primer 36 ensures that the shear or tearing strength of the bond between the sealant 34 and the barrier layer 20 of the bead is weaker than that between the sealant 32 on the membrane and the sealant 34 on the bead, and also weaker than that between the sealant 32 and the membrane's foil layer 28.

The sealants 32 and 34 can comprise identical heat-seal materials or can comprise different heat-seal materials. Advantageously, the sealants comprise an ethylene acid copolymer, such as methacrylic acid or acrylic acid, having acid groups partially neutralized with zinc or sodium ions. Examples of suitable materials of this type include SURLYN® and TRANCEND®, both available from Dupont.

The primer 36 can comprise a two-part urethane primer system having a hydroxyl-terminated polyol component and a di-functional isocyanate component that are kept separate until it is desired to use them. The components when mixed together react to form a urethane having strong z-direction bonding properties. Examples of suitable two-part urethane primer systems that can be used in the practice of the invention include Rohm & Haas/Morton 522A/522B and 522A/532B. These primer systems are particularly useful when bonding either SURLYN® or TRANCEND® to a barrier layer 20 of OPET or OPP. Alternatively, the primer can comprise a LIOFOL adhesive available from Henkel Adhesives Corporation. The surface of the barrier layer 20 can be subjected to a corona discharge or chemical treatment, if desired, as a way of further controlling the bond strength between the primer and the barrier layer.

In addition to the use of the primer 36, other factors can also influence the strength of the membrane-to-bead bond, the resistance of the bond to internal pressure in the container, and the ease of peeling the membrane from the bead. For example, it is advantageous to form an inner wedge 40 of the combined sealant materials 32 and 34 at the juncture between the membrane 26 and the bead 22 toward the inside of the container, and an outer wedge 42 of the sealant materials at the membrane-bead juncture toward the outside of the container, as illustrated in FIGS. 1, 3, and 4. Such sealant wedges are described in U.S. Pat. No. 5,979,748 assigned to the assignee of the present application and incorporated herein by reference. The sealant wedges, and particularly the inner wedge 40, help resist detachment of the membrane caused by internal pressure in the container acting on the membrane normal thereto in an upward direction. The inner wedge 40 preferably is larger than the outer wedge 42. Additionally or alternatively, it can be advantageous to form the bead 22 so that it has a somewhat flattened upper end in such a manner that the bead surface area to which the membrane is sealed is increased relative to an arcuate bead shape.

Figure 5:
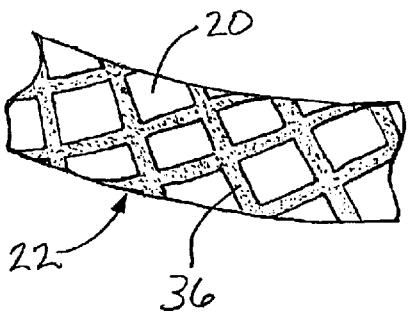
FIG. 5 is a view looking axially down upon a portion of a bead of a container, showing a liner having a pattern-applied primer in accordance with another embodiment of the invention.

In another aspect of the invention, the primer can be applied to the polymer barrier layer 20 of the liner in a partial-coverage pattern rather than fully covering the entire surface of the liner. For instance, the primer can be applied to the liner using a gravure cylinder having engraved or etched recesses in its surface in the desired pattern. The pattern of application of the primer advantageously is such that the bond strength that the primer provides between the liner film 20 and the sealant 34 is not constant all around the bead 22. Instead, the pattern creates at least one zone of relatively lower bond strength compared to other regions of the bead, thus forming a location at which peeling of the membrane from the bead can be initiated. The weakened zone can be created in various ways. For instance, the pattern of primer on the bead can include a region having a smaller thickness of primer than at other locations on the bead, the thinner region providing lower bond strength than the thicker regions. The thickness of the primer can be regulated by the depth of the engraved or etched areas in the gravure cylinder used for applying the primer to the liner; deeper recesses apply thicker primer areas while shallower recesses apply thinner primer areas. Alternatively, the pattern can be such that some areas of the liner have no primer while primer is applied to other areas. For instance, the pattern can comprise a cross-hatch pattern as depicted in FIG. 5, which is a view looking axially down upon a portion of the bead 22 of a container. The cross-hatch pattern consists of spaced parallel lines of primer 36 extending in a first direction of the liner 20, such as the length direction of the liner strip, intersected by spaced parallel lines of primer extending in a second direction, such as perpendicular to the first direction. The primer pattern on the bead preferably is such that at no point around the bead is there a path from inside to outside the container that lacks primer coverage. Thus, in the case of the cross-hatch pattern of FIG. 5, for example, the spacing between the lines of primer should be less than the width of the top sealing surface of the bead. For instance, if the top sealing surface of the bead is 1/16-inch wide, the lines of primer can be spaced up to about 1/32-inch apart. Cross-hatch patterns are not the only type of patterns that can be used. For instance, the pattern can comprise interconnected shapes (e.g., circles, squares, triangles, etc.), sawtoothed or wavy lines, and other configurations. The spacing between different regions of primer preferably should be small enough to ensure that no area of the top sealing surface of the bead will fall within a space between such primer regions.

The pattern application of primer may allow use of a primer of relatively greater bond strength than would otherwise be possible, because the pattern application enables the bond strength to be controlled as desired.

Another way of controlling the bond strength in accordance with another aspect of the invention is to chemically treat the barrier layer 20 (e.g., with an alkyd) and then apply the primer to the chemically treated layer. The chemical treatment causes the primer to detach from the barrier layer (similar to FIG. 4) when the membrane is peeled from the bead.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A composite container, comprising:

a container body comprising from one to a plurality of paperboard plies wrapped about an axis and adhered together to form a tubular body wall of the container body, the tubular body wall having an inner surface and an outer surface, and a substantially fluid-impervious liner covering and adhered to the inner surface of the tubular body wall, the liner comprising a non-foil-based polymer liner having a polymer film barrier layer;

a rolled bead formed at least at one end of the container body;

a flexible membrane closure seated to an end surface of the bead for closing the one end of the container body, a first heat seal material being disposed on the end surface of the bead, a second heat seal material being disposed on the membrane closure and cooperating with the first heat seal material to seal the membrane closure onto the bead;

wherein the first heat seal material is joined to the polymer film barrier layer of the liner by a primer layer disposed therebetween, the primer layer providing a relatively high z-direction bond strength between the first heat seal material and the barrier layer while providing a shear strength that is weaker than that between the first and second heat seal materials and weaker than that between the second heat seal material and the membrane closure such that peeling of the membrane closure from the end surface of the bead tends to cause the first heat seal material to remain attached to the membrane closure and to be detached from the barrier layer at the end surface of the bead.

2. The composite container of claim 1, wherein the barrier layer of the liner comprises a metallized polymer film.

3. The composite container of claim 1, wherein the first heat seal material covers one entire surface of the barrier layer and forms an inner surface of the container that comes in contact with product contained in the container.

4. The composite container of claim 1, wherein the barrier layer is selected from the group consisting of polypropylene, polyethylene terephthalate, and nylon.

5. The composite container of claim 4, wherein the primer layer comprises a urethane primer system.

6. The composite container of claim 5, wherein the first heat seal material comprises ethylene acid copolymer having acid groups partially neutralized with zinc or sodium ions.

7. The composite container of claim 6, wherein the second heat seal material comprises ethylene acid copolymer having acid groups partially neutralized with zinc or sodium ions.

8. The composite container of claim 5, wherein the barrier layer of the liner is metallized.

9. The composite container of claim 1, wherein the first and second heat seal materials form an inner wedge and an outer wedge at a juncture between the membrane and the bead, the inner wedge being located radially inward of a heat seal area between the end surface of the bead and the membrane and the outer wedge being located radially outward of the heat seal area.

10. The composite container of claim 9, wherein the inner wedge is larger than the outer wedge.

11. The composite container of claim 1, wherein the primer is applied to the barrier layer in a partial-coverage pattern.

12. The composite container of claim 11, wherein the pattern of primer creates a zone on the bead having a weaker bond between the barrier layer and the heat seal layer than at other locations on the bead.

13. The composite container of claim 1, wherein the barrier layer is chemically treated and the primer is applied to the chemically treated barrier layer.

14. A composite container body, comprising:

from one to a plurality of paperboard plies wrapped about an axis and adhered together to form a tubular body wall of the container body, the tubular body wall having an inner surface and an outer surface, and a substantially fluid-impervious liner covering and adhered to the inner surface of the tubular body wall, the liner comprising a non-foil-based polymer liner having a polymer film barrier layer;

a heat seal layer joined to the barrier layer so as to form an innermost surface of the container body; and a rolled bead formed at a top end of the container body, the heat seal layer thus being exposed at an end surface of the bead;

wherein a primer is disposed between the heat seal layer and the barrier layer, the primer comprising a urethane, the primer creating a frangible bond between the heat seal layer and the barrier layer.

15. The container body of claim 14, wherein the heat seal layer comprises ethylene acid copolymer.

16. The container body of claim 15, wherein the barrier layer is selected from the group consisting of polypropylene, polyethylene terephthalate, and nylon.

17. The container body of claim 16, wherein the barrier layer is metallized.

18. The container body of claim 16, wherein the barrier layer is oriented.

19. The container body of claim 14, wherein the primer is applied to the barrier layer in a partial-coverage pattern.

20. The container body of claim 19, wherein the pattern of primer creates a zone on the bead having a weaker bond between the barrier layer and the heat seal layer than at other locations on the bead.

21. The container body of claim 14, wherein the barrier layer is chemically treated and the primer is applied to the chemically treated barrier layer.

* * * * *